US005853926A

United States Patent [19]

Bohan et al.

[11] Patent Number: 5,853,926

[45] Date of Patent: Dec. 29, 1998

[54] PRE-COATED, FUSED PLASTIC PARTICLES AS A PROTECTIVE OVERCOAT FOR COLOR PHOTOGRAPHIC PRINTS

[75] Inventors: Anne E. Bohan, Pittsford; Vito A. DePalma, Rochester; William K. Goebel, Rochester; Amy E. Jasek, Rochester; Thomas H. Whitesides, Rochester, all of N.Y.

[73] Assignee: Eastman Kodak Company, Rochester, N.Y.

[21] Appl. No.: 898,987

[22] Filed: Jul. 23, 1997

[51] Int. Cl.[6] ..... G03C 1/76; G03C 11/08

[52] U.S. Cl. ..... 430/14; 430/444; 430/350; 430/463; 430/531; 430/533; 430/536; 430/961

[58] Field of Search ..... 430/444, 463, 430/350, 961, 536, 531, 533, 14

[56] References Cited

U.S. PATENT DOCUMENTS

| | | | |
|---|---|---|---|
| 2,173,480 | 9/1939 | Jung . | |
| 2,259,009 | 10/1941 | Talbot . | |
| 2,331,746 | 10/1943 | Talbot . | |
| 2,706,686 | 4/1955 | Hilborn . | |
| 2,798,004 | 7/1957 | Weigel . | |
| 3,113,867 | 12/1963 | Van Norman et al. | 96/87 |
| 3,190,197 | 6/1965 | Pinder . | |
| 3,397,980 | 8/1968 | Stone | 96/50 |
| 3,415,670 | 12/1968 | McDonald . | |
| 3,443,946 | 5/1969 | Grabhofer et al. | 96/50 |
| 3,502,501 | 3/1970 | Burczyk et al. | 430/961 |
| 3,697,277 | 10/1972 | King | 430/950 |
| 3,733,293 | 5/1973 | Gallagher et al. | 260/29.6 |
| 4,092,173 | 5/1978 | Novak et al. | 430/961 |
| 4,171,979 | 10/1979 | Novak et al. | 430/463 |
| 4,333,998 | 6/1982 | Leszyk | 430/523 |
| 4,426,431 | 1/1984 | Harasta et al. | 430/14 |
| 4,554,235 | 11/1985 | Adair et al. | 430/350 |
| 4,999,266 | 3/1991 | Platzer et al. | 430/14 |
| 5,179,147 | 1/1993 | Jones | 524/261 |
| 5,447,832 | 9/1995 | Wang et al. | 430/523 |

*Primary Examiner*—Richard L. Schilling
*Attorney, Agent, or Firm*—Carl F. Ruoff

[57] ABSTRACT

The present invention is an imaged photographic element having a protective overcoat thereon. The protective overcoat is formed by providing a photographic element having at least one silver halide light-sensitive emulsion layer; and applying an aqueous coating comprising polymer particles having an average size of 0.1 to 50 microns at a weight percent of 5 to 50 percent, a soft polymer latex binder at a weight percent of 1 to 3 percent, over the at least one silver halide light-sensitive emulsion layer. The silver halide light sensitive emulsion layer is developed to provide an imaged photographic element. The hydrophobic polymer particles is fused to form a protective overcoat.

13 Claims, No Drawings

PRE-COATED, FUSED PLASTIC PARTICLES AS A PROTECTIVE OVERCOAT FOR COLOR PHOTOGRAPHIC PRINTS

CROSS REFERENCE TO RELATED APPLICATIONS

This application relates to commonly assigned copending application Ser. No. 08/898,985, filed simultaneously herewith and hereby incorporated by reference for all that it discloses.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are descibed in U.S. Pat. Nos. 2,259,009, 2,331,746, 2,798,004, 3,113,867, 3,190,197, 3,415,670 and 3,733,293. The application of UV-polymerizable monomers and oligomers on processed image followed by radiation exposure to form crosslinked protective layer is described U.S. Pat. Nos. 4,092,173, 4,171,979, 4,333,998 and 4,426,431. One drawback for the solvent coating method and the radiation cure method is the health and environmental concern of those chemicals to the coating operator. U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing mixture of high and low Tg latices as the water-resistance layer to preserve the antistat property of the $V_2O_5$ layer through photographic processing. This protective layer is not applicable to the image formation layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective.

There remains a need for an aqueous coatable, water-resistant protective overcoat that can be incorporated into the photographic product, allows for appropriate diffusion of photographic processing solutions, and does not require coating operation after exposure and processing.

SUMMARY OF THE INVENTION

The present invention is an imaged photographic element having a protective overcoat thereon. The protective overcoat is formed by providing a photographic element having at least one silver halide light-sensitive emulsion layer; and applying an aqueous coating comprising polymer particles having an average size of 0.1 to 50 microns at a weight percent of 5 to 50 percent, a soft polymer latex binder at a weight percent of 1 to 3 percent, over the at least one silver halide light-sensitive emulsion layer. The silver halide light sensitive emulsion layer is developed to provide an imaged photographic element. The hydrophobic polymer particles is fused to form a protective overcoat.

DETAILED DESCRIPTION OF THE INVENTION

The aim of this invention is to provide a protective overcoat to the emulsion side of photographic products, particularly photographic prints. The protective overcoat of the invention is coatable from aqueous solution, survives exposure and processing, and forms a continuous, water-impermeable protective layer in a post-process fusing step. The overcoat is formed by coating polymer beads or particles of 0.1 to 50 microns in average size together with a polymer latex binder on the emulsion side of a sensitized photographic product. Optionally, a small amount of water-soluble coating aids (viscosifiers, surfactants) can be included in the layer, as long as they leach out of the coating during processing. After exposure and processing, the product with image is treated in such a way as to cause fusing and coalescence of the coated polymer beads, by heat and/or pressure (fusing), solvent treatment, or other means so as to form the desired continuous, water impermeable protective layer.

Examples of polymers from which the polymer particles used in this invention can be selected include poly(vinyl chloride), poly(vinylidene chloride), poly(vinyl chloride-co-vinylidene chloride), chlorinated polypropylene, poly(vinyl chloride-co-vinyl acetate), poly(vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, such as polystyrene and polyvinyltoluene or copolymer of vinyl polymers with methacrylates or acrylates, poly(tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly(methyl methacrylate), copolymers with siloxanes and polyalkenes. These polymers can be used either alone or in combination. In a preferred embodiment of the invention, the polymer comprises a polyester or poly (styrene-co-butyl acrylate). Preferred polyesters are based on ethoxylated and/or propoxylated bisphenol A and one or more of terephthalic acid, dodecenylsuccinic acid and fumaric acid.

To increase the abrasion resistance of the overcoat, polymers which are crosslinked or branched can be used. For example, poly(styrene-co-indene-co-divinylbenzene), poly (styrene-co-acrylonitrile-co-divinylbenzene), or poly (styrene-co-butadiene-co-divinylbenzene) can be used.

The polymer particles should be clear, i.e., transparent, and are preferably colorless. But it is specifically contemplated that the polymer particle can have some color for the purposes of color correction, or for special effects, so long as the image is viewable through the overcoat. Thus, there can be incorporated into the polymer particle dye which will impart color. In addition, additives can be incorporated into the polymer particle which will give to the overcoat desired properties. For example, a UV absorber can be incorporated into the polymer particle to make the overcoat UV absorptive, thus protecting the image from UV induced fading.

In addition to the polymer particles which form the overcoat there can be combined with the polymer composition other particles which will modify the surface characteristics of the element. Such particle are solid and nonfusible at the conditions under which the polymer particles are fused, and include inorganic particles, like silica, and organic particles, like methylmethacrylate beads, which will not melt during the fusing step and which will impart surface roughness to the overcoat.

The surface characteristics of the overcoat are in large part dependent upon the physical characteristics of the polymer which forms the toner and the presence or absence of solid, nonfusible particles. However, the surface characteristics of the overcoat also can be modified by the conditions under which the surface is fused. For example, the surface characteristics of the fusing member that is used to fuse the toner to form the continuous overcoat layer can be selected to impart a desired degree of smoothness, texture or pattern to the surface of the element. Thus, a highly smooth fusing member will give a glossy surface to the imaged element, a textured fusing member will give a matte or otherwise textured surface to the element, a patterned fusing member will apply a pattern to the surface of the element, etc.

Examples of the polymer latex binder include a latex copolymer of butyl acrylate, 2-acrylamido-2-methylpropanesulfonate, and acetoacetoxyethylmethacrylate. Other latex polymers which are useful include polymers having a 20 to 10,000 nm diameter a Tg of less than 60° C. suspended in water as a colloidal suspension.

Examples of coating aids include any water soluble polymer or other material that imparts appreciable viscosity to the coating suspension, such as high MW polysaccharide derivatives (e.g. xanthan gum, guar gum, gum acacia, Keltrol (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are preferred imaged photographic elements for use in this invention.

While a primary purpose of applying an overcoat to imaged photographic elements in accordance with this invention is to protect the element from physical damage, application of the overcoat may also protect the image from fading or yellowing. This is particularly true with elements which contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

The photographic elements in which the images to be protected are formed can have the structures and components shown in Research Disclosures 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosures 37038 and 38957. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occuring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emiting devices (such as LEDs, CRTs, etc.)

Images can be developed in photographic elements in any of a number of well known photographic processes utilizing any of a number of well known processing compositions, described, for example, in T. H. James, editor *The Theory of the Photographic Process,* 4th Edition, Macmillan, New York, 1977. In the case of processing of color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The present invention is illustrated by the following examples.

EXAMPLES

Test for water permeability

Ponceau Red dye (a gelatin stain) was dissolved in a mixture of acetic acid and water (5 parts: 95 parts) at a concentration of 0.1%. A drop of this solution was placed on the coating to be tested and the drop covered with a 20 mm×20 mm square microscope slide cover slip. After standing at room temperature for several minutes, the cover slip was removed, and the excess dye was washed off with a stream of water. The coating was examined for dye incorporation (a residual red stain) either visually, microscopically (to examine pinhole failures) or by densitometry (for generally permeable coatings). Permeability under several sets of conditions was examined: before fusing, after simple fusing, and after processing (using Ektacolor RA4 developer and bleach/fix process chemicals at 33° C.), drying, fusing. In the first case, the permeability should be high to allow access to process chemicals and the residual dye stain should be high; in the latter two case, the permeability should be low, and essentially no dye should be retained.

In the description of the examples, all compositions are given in percent by weight.

Example 1

Melts were prepared using 12 $\mu$m particles of ground polyester or ground styrene-butadiene toners at a laydown of 600 mg/ft$^2$, 200 mg/ft$^2$ of gelatin and surfactant at 1 weight percent of the melt. These melts were bead-coated onto a roll of paper previously coated with Ektacolor EDGE emulsions in a formulation described below.

| Layer | Laydown (mg/sq. ft.) |
|---|---|
| Overcoat | 120.0 gelatin |
| | 1.0 SURF-1 |
| | 0.39 SURF-2 |
| | 8.87 HAR-1 |
| UV | 12.11 UV-1 |
| | 2.13 UV-2 |
| | 3.57 SCV-1 |
| | 2.37 S-1 |
| | 2.37 S-2 |
| | 47.5 Gelatin |
| Cyan | 18.1 Red light sensitive AgX |
| | 39.31 C-1 |
| | 38.52 S-2 |
| | 3.22 S-3 |
| | 25.31 UV-1 |
| | 129.0 Gelatin |
| UV | 17.43 UV-1 |
| | 3.07 UV-2 |
| | 5.14 SCV-1 |
| | 3.41 S-1 |
| | 3.41 S-2 |
| | 68.4 Gelatin |
| Magenta | 7.70 Green-light sensitive AgX |
| | 1.11 KCL |
| | 29.5 C-2 |
| | 8.26 S-2 |
| | 3.54 S-4 |
| | 17.7 ST-1 |
| | 2.01 ST-2 |
| | 57.0 ST-3 |
| | 0.05 FOG-1 |
| | 0.285 Nitric Acid |
| | 117.0 Gelatin |
| IL | 6.12 SCV-1 |
| | 18.4 S-2 |
| | 6.025 3,5-Disulfocatechol disodium salt |
| | 0.524 Nitric Acid |
| | 0.18 SURF-1 |
| | 70.0 Gelatin |
| Yellow | 24.0 Blue-light sensitive AgX |
| | 45.0 C-3 |
| | 45.0 P-1 |
| | 20.3 S-2 |
| | 0.88 SCV-2 |
| | 141.8 Gelatin |

Photographic paper support
sublayer 1: resin coat (Titanox and optic brightener in polyethylene)
sublayer 2: paper
sublayer 3: resin coat (polyethylene)

C-1 Butanamide 2-[2,4-bis(1,1-dimethylpropyl)phenoxy]-N-(3,5-dichloro-4-ethyl-2-hydroxyphenyl)

C-2

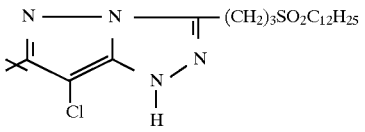

C-3

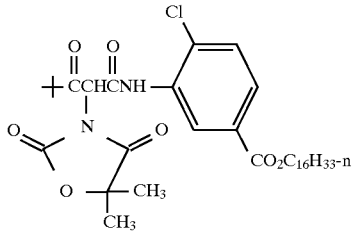

FOG-1

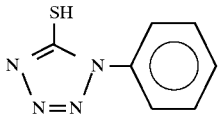

HAR-1

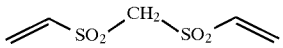

P-1

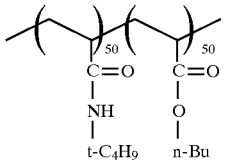

S-1 1,4-Cyclohexylenedimethylene bis(2-ethylhexaneoate)

S-2

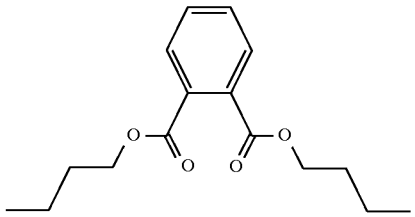

S-3 2-(2-Butoxyethoxy)ethyl acetate

S-4 Di-undecylphthalate

SCV-1

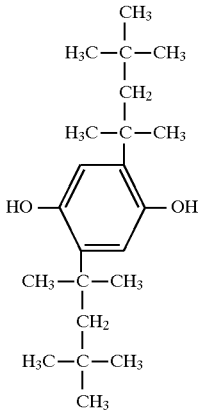

SCV-2 benzenesulfonic acid 2,5-dihydroxy-4-(1-methylhepta-decyl)-monopotassium salt -continued

ST-1

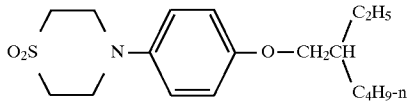

ST-2

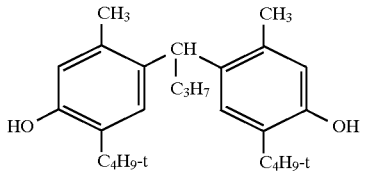

ST-3

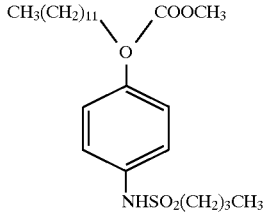

SURF-1

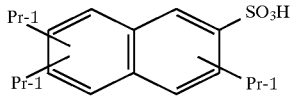

.1 Na

SURF-2 $C_8F_{17}SO_3N(C_2H_5)_4$

UV-1

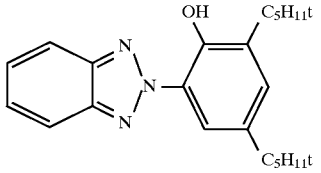

UV-2

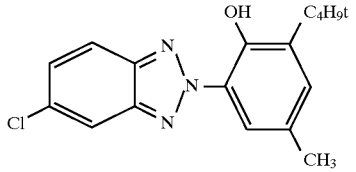

The resultant coatings were exposed and processed through standard RA4 chemistry. The coatings were visually examined for water resistance by wetting the sample with a small amount of water and observing the swell of the gelatin. This observation was made on samples before and after fusing with heat and pressure. The coatings prior to fusing had a very matte appearance and a somewhat cloudy appearance and showed essentially no resistance to water. After fusing the images were clear and had very high gloss. The fused images also showed no resistance to swelling by water. Examination of microscopic cross-sections of these coatings showed that while the fusing had flattened the tops of the polymeric particles, improving the gloss, the particles were still essentially uncoalesced and there were obvious gelatin pathways for the water to penetrate down to the emulsion layers.

Following these coatings an attempt was made to reduce the level of gelatin in the coatings in order to improve coalescence of the polymer. A series of coatings was made varying the ratio of toner: gelatin from 600:0 to 600:200. The coatings with no gelatin proved very difficult to coat well and had very poor adhesion. However, even at very low levels of gelatin (1000 mg/ft$^2$ polymer: 1 mg/ft$^2$ of gelatin) it proved impossible to adequately coalesce the polymeric particles into a uniform continuous layer in the presence of gelatin, such that the fused coating was impermeable to water.

This example shows that even very low levels of hydrophilic polymer binder are sufficient to prevent coalescence by fusing of the polymeric particles in the overcoat. Even though good adhesion and coatability could be obtained in the presence of such a binder, the resulting coating does not protect the exposed and processed image from water and fingerprint damage.

Example 2

Melts were prepared using 7.5 micron ground polymer particles (styrene butyl acrylate available from Hercules as Piccotoner 1221), a soft latex binder (copolymer of butyl acrylate, 2-acrylamido-2-methylpropanesulfonate, and acetoacetoxyethylmethacrylate) as a 20% suspension, a hydrophilic thickening agent (Keltrol T) as a 1% solution, and a surfactant (Olin 10G) as a 10% solution. A small amount of methyl orange dye was also included to allow easier monitoring of coating quality (2 g of a 0. 1% solution/20 g of melt). The melts were each hand-coated using a 3 mil coating knife on resin-coated paper overcoated with a 547 mg/ft$^2$ gelatin pad hardened with bisvinylsulfonylmethylether at 2.43%. After spreading, the coatings were dried at 30° C. The compositions listed in Table 1 were coated.

TABLE 1

| Sample | Polymer particles | Latex binder | Thickener (Keltrol T) | Surfactant (Olin 10G) |
|---|---|---|---|---|
| 1 | 10% | 1% | 0.05% | 0.1% |
| 2 | 10% | 1% | 0.025% | 0.1% |
| 3 | 10% | 1% | 0.012% | 0.1% |
| 4 | 10% | 2% | 0.05% | 0.1% |
| 5 | 10% | 2% | 0.025% | 0.1% |
| 6 | 10% | 2% | 0.012% | 0.1% |

Sections of these coatings were sandwiched between two sheets of Mylar film and passed through a set of heated pressurized rollers operating at 107° C. and an air supply pressure of 65 psi. The permeability of the coatings was evaluated using the Ponceau Red dye stain test as described above both before and after fusing. The results of these tests are summarized in table 2. For unfused samples, the status M transmission density of a dyed area was compared with that of an adjacent undyed area. A large value of the difference in densities indicates that the unfused, coated sample is still highly permeable to water (and dye). These values are listed in the column labeled "Unfused Permeability". For the fused samples, the status M transmission density of a dyed area was compared to a comparable dyed area of the unfused coating. A large value of the difference indicates that the permeability of the fused coating to water is low. These data are listed in the column labeled ΔD.

TABLE 2

| Sample | Unfused Permeability[a] | ΔD[b] | Remarks |
|---|---|---|---|
| 1 | 1.70 | 0.62 | |
| 2 | 1.64 | 1.36 | |
| 3 | 1.67 | 1.31 | |

TABLE 2-continued

| Sample | Unfused Permeability[a] | ΔD[b] | Remarks |
|---|---|---|---|
| 4 | 0.99 | 0.47 | repeated passes through the fuser resulted in higher ΔD values, to 0.81 after three passes |
| 5 | 1.29 | 0.93 | |
| 6 | 1.45 | 1.54 | |
| no coating | 1.70 | 0.00 | |

[a]Difference in transmission Status M green density between dyed and undyed area of the unfused coating
[b]Difference in transmission Status M green density between unfused, dyed coating and fused, dyed coating.

In all cases, the permeability of the coating after fusing was substantially lower than prior to fusing, and much less than without the protective coating altogether. Closer examination of the results in Table 2 shows that a. incorporation of more latex polymer binder into the mixture reduces the permeability prior to fusing (compare Samples 1–3 with Samples 4–6) and b. that more Keltrol T results in poor fusing (compare ΔDvalues within the series 1 (high Keltrol) to 3 (low Keltrol) and 4 (high Keltrol) to 6 (low Keltrol): as the Keltrol level falls, the amount of dye taken up by the fused coating falls, so that ΔD increases).

Example 3

Melts were prepared as above using bisphenol A polyester particles at several levels (10 micron particle size). These were applied to the same support as in Example 1 under the same conditions using a 3 mil coating knife. The coatings were fused and evaluated as before. The melt compositions and results are shown in Tables 3 and 4.

TABLE 3

| Sample | Polyester particles | Latex polymer binder | Thickener (Keltrol T) | Surfactant (Olin 10G) |
|---|---|---|---|---|
| 1 | 0% | 1% | 0.025% | 0.01% |
| 2 | 5% | 1% | 0.025% | 0.01% |
| 3 | 10% | 1% | 0.025% | 0.01% |
| 4 | 15% | 1% | 0.025% | 0.01% |
| 5 | 20% | 1% | 0.025% | 0.01% |
| 6 | 10% | 0% | 0.025% | 0.01% |

TABLE 4

| Sample | Unfused Permeability[a] | ΔD[b] | Remarks |
|---|---|---|---|
| 1 | 0.41 | 0.08 | Latex only, no particles |
| 2 | 1.08 | 0.66 | |
| 3 | 1.24 | 0.82 | |
| 4 | 1.28 | 0.90 | |
| 5 | 1.33 | 1.05 | |
| 6 | 1.75 | 1.20 | Adhesion of the coating was very poor both before and after fusing. |
| no coating | 1.61 | 0.00 | Bare support |

[a]Difference in transmission Status M green density between dyed and undyed area of the coating
[b]Difference in transmission Status M green density between unfused, dyed coating and fused, dyed coating.

In the absence of particles, using the latex binder only (Sample 1), the permeability of the coating was low even before fusing, showing that the binder is capable of forming an impermeable film on the surface by itself, but that a coating made with this surface treatment would not be processable. In the absence of the binder (Sample 6), the adhesion of the particles was extremely poor, the particles dusting off the surface easily on normal handling. The adhesion was much improved in the presence of the binder. The permeability of the fused coatings decreased with the coated level of particles, and was very close to zero at 20% (Sample 5), the residual dye density being the result of a few pinholes and other discrete defects in the coating.

Example 4

A series of melts were prepared and handcoated as described above, using the compositions in Table 5, in which the main feature is a variation in the level of latex binder. The coatings were tested before and after fusing, also as described above, with the results shown in Table 6.

TABLE 5

| Sample | Polyester particles | Latex polymer binder | Thickener (Keltrol T) | Surfactant (Olin 10G) |
|---|---|---|---|---|
| 1 | 20% | 1% | 0.025% | 0.1% |
| 2 | 20% | 3% | 0.025% | 0.1% |
| 3 | 20% | 5% | 0.025% | 0.1% |
| 4 | 20% | 7% | 0.025% | 0.1% |
| 5 | 20% | none | 0.025% | 0.1% |

TABLE 6

| Sample | Unfused Permeability[a] | Fused Permeability[b] | Dry adhesion |
|---|---|---|---|
| 1 | 0.84 | 0.00 | poor |
| 2 | 0.98 | 0.00 | OK |
| 3 | 1.60 | 0.00 | OK |
| 4 | 0.93 | 0.00 | OK |
| 5 | 0.31 | 0.00 | poor |

[a]Difference in transmission Status M green density between dyed and undyed area of the coating
[b]Difference in transmission Status M green density between fused, dyed area of the coating and a fused undyed area.

All of these coatings were impermeable after fusing, as indicated by the observation that no dye whatever was taken up by the coating (data column labeled "Fused Permeability", the difference in Status M transmission density between a dyed area of the fused coating and an adjacent area, not treated with dye. If there is no difference between these readings, no appreciable amount of dye was taken up by the coating. The permeability of the coatings before fusing decreased with the latex level above about 3% latex. In addition the uniformity of the hand coatings decreased above this level. The adhesion improved with higher levels of latex.

Example 5

Large-scale melts were prepared using polymer particle preparations made by evaporative limited coalescence techniques. The polymer was a bisphenol A-based polyester from KAO Corporation KAO Binder P. Three different particle sizes were investigated: 1.6 $\mu$m, 5.4 $\mu$m, and 11.0 $\mu$m. The melt compositions comprised 30% by weight polymer particles, 0.0625% Aerosol OT surfactant, 1% latex binder, and 0.03% Keltrol T. An attempt was made to coat each melt as an overcoat on Edge 5 Ektacolor Paper (on a roll as supplied commercially to a photofinisher). Only the melt made from the smallest particle size was coatable, since the other particles would not pass through the coating machine delivery system without jamming. The smallest particle melt was coated at a laydown of 677 mg/ft$^2$, and gave a high quality, uniform coating. A sample of this coating was exposed and processed using RA4 chemistry, and the resulting processed print fused as described above. The fused image was glossy and hard, and gave a reasonable image, but was not completely impermeable using the Ponceau Red test, showing a large number of pinhole failures, in a pattern suggesting that the laydown of the polymer particles was insufficient. Another coating was made using the small particle particles at three different laydowns (700, 1400, and 2000 mg/ft$^2$). These coatings were imaged and processed as before. The highest coating level on fusing gave an essentially impermeable coating and acceptable sensitometry.

The invention has been described in detail with particular reference to certain preferred embodiments thereof, but it will be understood that variations and modifications can be effected within the spirit and scope of the invention.

What is claimed is:

1. An imaged photographic element having a protective overcoat thereon, the protective overcoat formed by the steps comprising;

providing a photographic element having at least one silver halide light-sensitive emulsion layer;

applying an aqueous coating comprising polymer particles having an average size of 0.1 to 50 microns at a weight percent of 5 to 50 percent, and a polymer latex binder at a weight percent of 1 to 3 percent, over the at least one silver halide light-sensitive emulsion layer;

developing the at least one silver halide light sensitive emulsion layer to provide an imaged photographic element; and fusing the polymer particles to form a protective overcoat.

2. The imaged photographic element having the protective overcoat of claim 1 wherein the fusing comprises the application of heat.

3. The imaged photographic element having the protective overcoat of claim 1 wherein the fusing comprises the application of heat and pressure.

4. The imaged photographic element having the protective overcoat of claim 1 wherein coating further comprises coating aids selected from the group consisting of: xanthan gum, guar gum, gum acacia, an anionic polysaccharide, polyvinyl alcohol, carboxymethylcellulose, hydroxyethylcellulose, polyacrylic acid, salts of polyacrylic acid, polyacrylamide, alkyloxy- or alkylphenoxypolyether, polyglycidol derivatives, sulfates of polyglycidol derivatives, sodium octylphenoxypoly(ethyleneoxide) sulfate, organic sulfates, and organic sulfonates.

5. The imaged photographic element having the protective overcoat of claim 1 wherein the polymer particles comprise a polymer selected from the group consisting of poly(vinyl chloride), poly(vinylidene chloride), poly(vinyl chloride-co-vinylidene chloride), chlorinated polypropylene, poly(vinyl chloride-co-vinyl acetate), poly (vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, poly(tetrafluoroethylene-hexafluoropropylene), polyethylene, phenol-modified pentaerythritol esters, poly (styrene-co-indene-co-acrylonitrile), poly(styrene-co-indene), poly(styrene-co-acrylonitrile), poly(styrene-co-butadiene), poly(stearyl methacrylate) blended with poly (methyl methacrylate), copolymers with siloxanes and polyalkenes.

6. The imaged photographic element having the protective overcoat of claim 1 wherein the imaged photographic element is a photographic image on a transparent support.

7. The imaged photographic element having the protective overcoat of claim 1 wherein the imaged photographic element is a photographic image on a reflective support.

8. The imaged photographic element having the protective overcoat of claim 1 wherein the protective overcoat has a thickness of from 7 to 20 microns.

9. The imaged photographic element having the protective overcoat of claim 1 wherein the at least one silver halide emulsion layer is applied simultaneously with the applying the coating.

10. The photographic element having the protective overcoat of claim 1 wherein the particle size of the polymer particles is between 1 and 20 microns.

11. The photographic element having the protective overcoat of claim 1 wherein the polymer latex binder comprises a copolymer of butyl acrylate, 2-acrylamido-2-methylpropanesulfonate, and acetoacetoxyethylmethacrylate.

12. The photographic element having the protective overcoat of claim 1 above wherein the polymer latex binder has a Tg <100° C.

13. The photographic element having the protective overcoat of claim 1 wherein the coating has a viscosity of at least 5 mPa-s.

* * * * *